PTH17 XR 4,095,940 SR

United States Patent [19]
Weingarten

[11] 4,095,940
[45] Jun. 20, 1978

[54] PROCESS FOR THE PRODUCTION OF CAMOUFLAGE DYEINGS AND PRINTS

[75] Inventor: Rudolf Weingarten, Schwalbach, Taunus, Germany

[73] Assignee: Hoechst Aktiengesellschaft, Frankfurt am Main, Germany

[21] Appl. No.: 324,066

[22] Filed: Jan. 5, 1973

[30] Foreign Application Priority Data

Jan. 5, 1972 Germany ..... 2200323

[51] Int. Cl.² ..... D06P 1/00
[52] U.S. Cl. ..... 8/15; 8/1 D; 8/1 C
[58] Field of Search ..... 8/14, 15, 1 R, 1 C, 8/1 D

[56] References Cited

U.S. PATENT DOCUMENTS 2,115,329 4/1938 Dreyfus ..... 8/15
3,700,397 10/1972 Ramsley et al. ..... 8/14 X

*Primary Examiner*—Stephen J. Lechert, Jr.
*Attorney, Agent, or Firm*—Spencer & Kaye

[57] ABSTRACT

Process for the production of camouflage dyeings and prints on synthetic or regenerated fibers or foils or on blends containing synthetic or regenerated fibers, the dyed materials having infrared reflection values of from 20 to 50 percent within the infrared range between 700 and 1100 nm, by cross-dyeing or cover-printing fibers or foils made of the said materials and containing small amounts of carbon black as a mass coloration, with the dyestuff classes suiting the substrate concerned in shades that are suitable for camouflage colors in the visible range of the spectrum.

7 Claims, No Drawings

PROCESS FOR THE PRODUCTION OF CAMOUFLAGE DYEINGS AND PRINTS

The present invention relates to a process for the production of dyeings and prints that meet the requirements for camouflage articles in the visible range and in the infrared range of from 700 to 1100 nm.

As far as camouflage articles are concerned, regulations on their reflection values in the infrared range generally comply with the infrared reflection of chlorophyll (1. cf. K. Hoffmann, Melliand Textilberichte 35/1954, pages 285 to 286 and 396 to 399: 2. Farbstoffe fuer Infrarottarnung, edited by Ciba AG., Basle/Switzerland, year of edition not mentioned). This reflection shows a steep increase in the range of from 650 to 725 nm. For example, the reflection of a leaf of the horse-chestnut tree (Aesculus hippocastanum) in the range of from 650 to 1100 nm shows the following values (in percent):

| | | | | | | | | | | | |
|---|---|---|---|---|---|---|---|---|---|---|---|
| l | = | 650 | 675 | 700 | 725 | 750 | 775 | 800 | 900 | 1000 | 1100 nm |
| R | = | 4 | 3 | 16 | 36 | 46 | 50 | 52 | 58 | 62 | 66 % |

A corresponding increase to about 30 – 35% in the range of from 700 to 800 nm is required for camouflage colors, for which the reflection up to 1100 nm must not, however, exceed 50 percent. For example, limits to maximum and minimum reflection are set up according to the following regulations of the Danish Army:

At 700 nm, reflection is to be between 5 and 35 percent and, at 800 nm, between 30 and 50 percent. Up to 1100 nm, these values must not be higher or lower.

Pigments mixtures meeting these requirements are known, and most of the problem concerning the production of camouflage dyes for paint purposes is solved.

A more difficult task is to meet reflection requirements in the infrared range, as far as dyeings on textile materials are concerned. Some vat dyestuffs having a weak infrared reflection are known and allow dyeings to be produced, the infrared reflection of which fulfils the conditions for camouflage colors (cf. cited literature 2.). These dyeings are, however, limited to cellulose fibers. Under certain circumstances, even wool may lend itself to the production of dyeings having infrared reflection values useful for camouflage purposes.

This problem is, however, not at all solved for synthetic fibers, such as acetate fibers, polyester, polyamide or polyacrylonitrile fibers and the corresponding foils. The dyestuffs used for the dyeing and coloring of these materials have a weak or even no absorptive power in the near infrared range, and it is therefore not possible to reduce reflection values in the wave length range of up to 1100 nm to less than 50 percent.

Alternatively, it is known that fibers, which have been spun-dyed with carbon black, have a more or less pronounced absorptive power, depending on the addition of carbon black, and thus allow easy production of spun-dyed fibers, the reflection of which in the near infrared range is situated below 50 percent (cf. cited literature 1.).

For example, the reflection curve of spun-dyed polyester rayon, produced with 0.02 percent of carbon black, is getting from 33 percent at 500 nm in an almost linear manner to 39 percent at 1100 nm.

Such a spun-dyed material, however, has two disadvantages that obviate its use for camouflage purposes:

(a) It does not show the required steep increase of the reflection values at about 700 nm, which is characteristic of chlorophyll, and (b) it shows a grey shade in the visible wave range instead of khaki, olive or brown shades desired for camouflage purposes.

It has now been found that the conditions mentioned sub (a) and (b) can be fulfilled, and camouflage dyeings, colorations and prints having infrared reflection values of from 20 to 50 percent in the infrared range between 700 and 1100 nm are obtained on synthetic or regenerated fibers or foils or on mixtures containing synthetic or regenerated fibers, by cross-dyeing or co-er-printing fibers or foils made of the cited materials and containing small amounts of carbon black (medium particle size: 22 to 27 nm) as a mass coloration, with the dyestuff classes suiting the substrate concerned in shades that serve camouflage purposes in the visible range of the spectrum.

The synthetic fibers or foils to be used according to this invention contain carbon black as a mass coloration generally in amounts of from 0.005 to 0.5 percent by weight, preferably from 0.01 to 0.1 percent by weight. The shade in the visible wave range is only slightly altered by the carbon black content of the substrate.

According to the process of this invention, any commercial dyestuff assortment available for the dyeing or printing of the said fibers may be used along with any dyeing method common in practice. A selection of the dyestuffs, for example, as to chemical constitution or infrared reflection values is not required. In the case of polyester fibers, for example, disperse dyestuffs may be used according to the exhaustion method in the presence of carrier substances or under high temperature conditions or according to the pad or thermofixation method. Polyamide fibers may be dyed with disperse dyestuffs, acid or metal complex dyestuffs.

As to regenerated cellulose fibers, reactive dyestuffs are suitable according to all conventional methods.

The following Examples illustrate the invention, the parts and percentages being by weight unless stated otherwise.

EXAMPLE 1

(a) Combed material made of linear polyethylene terephthalate fibers was dyed at boiling temperature in a goods-to-liquor ratio of 1:20 over 90 minutes with an aqueous liquor which, calculated on the weight of the dry goods, contained 0.4% of a disperse dyestuff consisting of a mixture (of about the same portions) of compounds corresponding to the formulae

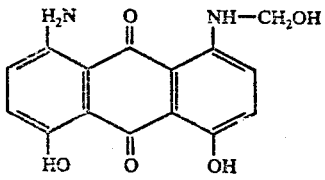

and

-continued

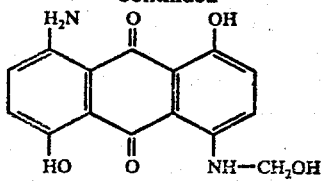

0.8% of the disperse dyestuff of the formula

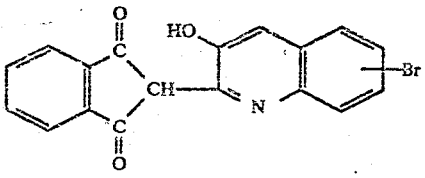

and 2.5 g/l of an emulsified carrier on o-phenyl-phenol basis.

After the goods thus dyed had been finished, a clear green dyeing was obtained, the infrared reflection of which, however, already reached a value of 90% at 800 nm and which is therefore not suitable for a camouflage article.

(b) When the same dyeing was, however, produced on polyester material that had previously been spun-dyed with 0.01% of carbon black (in a suitable form and particle size), the result was a green dyeing, the infrared reflection of which increased, in the range between 675 and 725 nm, from 9 percent to 32 percent and at 1100 nm reached a value of 49 percent. These values comply with the requirements set up by the Danish Army.

The material that had been spun-dyed with carbon black alone (without cross-dyeing) did not meet these requirements.

EXAMPLE 2

Polyester material that had been spun-dyed with 0.02% of carbon black was cross-dyed at 130° C over 75 minutes in a goods-to-liquor ratio of 1:20 with an aqueous liquor which, calculated on the weight of the dry goods, contained 0.4% of the disperse dyestuff of the formula

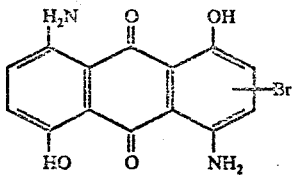

(1), 0.4% of the disperse dyestuff of the formula

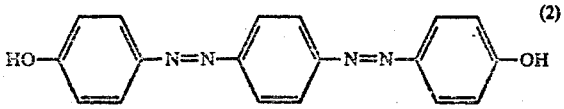

(2)

and 0.5% of the disperse dyestuff of the formula

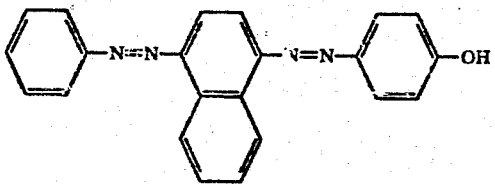

(3)

The material showed an olive shade as required for military articles. The maximum infrared reflection of the dyeing in the range between 700 and 1100 nm was 40 percent.

EXAMPLE 3

Polyester fiber material that had been spun-dyed with 0.04% of carbon black was dyed under the conditions indicated in Example 2 and with the dyestuffs mentioned there, but in the following amounts:

0.12% of the disperse dyestuff of formula (1),
0.6% of the disperse dyestuff of formula (2) and
0.6% of the disperse dyestuff of formula (3).

The goods showed a khaki shade suitable for camouflage articles and having a maximum infrared reflection of the dyeing of 36 percent at 1100 nm.

EXAMPLE 4

Polyamide-6 fiber material that had been spun-dyed with 0.075% of carbon black was dyed at boiling temperature over 90 minutes in a goods-to-liquor ratio of 1:20 with an aqueous liquor which contained, calculated on the weight of the dry goods, the following components: 0.4% of the acid dyestuff of the formula

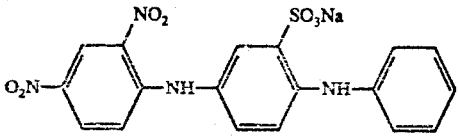

(Acid Orange 3 - C.I. No. 10385), 0.15% of the acid dyestuff of the formula

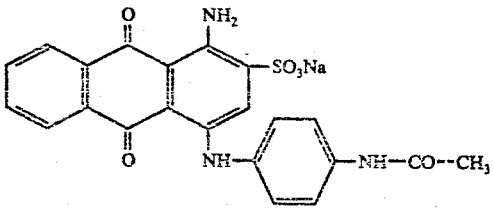

(Acid Blue 40 - C.I. No. 62125), and 0.05 g/l of a levelling agent on the basis of the reaction product of 1 mol of stearyl amine with 12 mols of ethylene oxide, 0.5 g/l of sodium acetate (crystallized) and 1.0 ml/l of acetic acid (of 60% strength).

The goods showed an olive shade suitable for camouflage purposes and having a maximum infrared reflection of the dyeing of 34 percent in the range of from 700 to 1100 nm.

EXAMPLE 5

Polyamide-6,6 fiber material that had been spun-dyed with 0.1% of carbon black was dyed at boiling temperature over 75 minutes in a goods-to-liquor ratio of 1:20 with an aqueous liquor which, calculated on the weight of the dry goods, contained 0.1% of the 1:2 chromium complex compound of the dyestuff of the formula

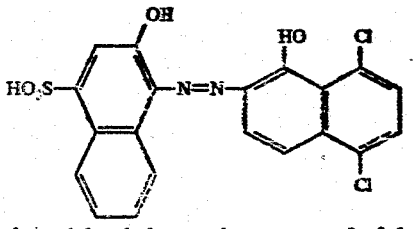

0.8% of the 1:2 cobalt complex compound of the dyestuff of the formula

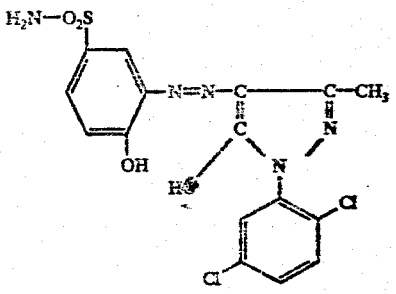

0.5% of a levelling agent consisting of equal parts of the reaction product of 1 mol of 2-heptadecyl-4-ethyl-4-hydroxymethyl-oxazoline with 90 mols of ethylene oxide and of the reaction product of 1 mol of 2-amino-2-ethylpropanediol-(1,3)-stearate with 90 mols of ethylene oxide, as well as 0.5 g/l of crystallized trisodium phosphate. After a boiling period of 30 minutes, 1.0 g/l of acetic acid (of 60% strength) was added to this liquor.

The goods showed an olive shade suitable for camouflage purposes and having a maximum reflection of the dyeing of 39 percent in the infrared range between 700 and 1100 nm.

EXAMPLE 6

Polyamide-6 fiber material that had been spun-dyed with 0.05% of carbon black was dyed at 130° C over 60 minutes in a goods-to-liquor ratio of 1:20 with an aqueous liquor containing, calculated on the weight of the dry goods, the following dyes: 0.4% of the disperse dyestuff of formula (1) indicated in Example 2 and 0.8% of the disperse dyestuff of formula (2) indicated in Example 2.

The goods showed an olive shade having a maximum infrared reflection of the dyeing of 44 percent at up to 1100 nm.

EXAMPLE 7

A cellulose 2 1/2-acetate foil that had been mass-colored with 5% of titanium dioxide and 0.03% of carbon black was colored at 80° C over 60 minutes in a goods-to-liquor ratio of 1:20 with an aqueous liquor containing — calculated on the weight of the dry material — the following dyestuffs: 0.4% of the disperse dyestuff of formula (1) indicated in Example 2 and 0.8% of the disperse dyestuff of formula (2) indicated in Example 2.

The material showed a green-olive shade having a maximum infrared reflection of the coloration of 45 percent at up to 1100 nm.

EXAMPLE 8

Regenerated cellulose fiber (viscose rayon) that had been spun-dyed with 0.036% of carbon black was dyed at 60° C over 90 minutes in a goods-to-liquor ratio of 1:20 with an aqueous liquor containing — calculated on the weight of the dry material — the following components: 0.8% of the reactive dyestuff of the formula

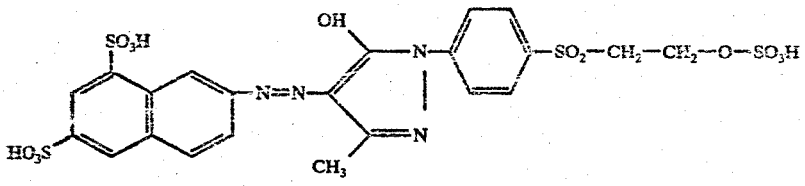

0.8% of the reactive dyestuff of the formula

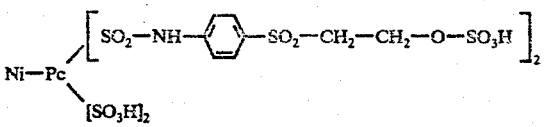

(Ni-Pc = nickel phthalocyanine) as well as 50 g/l of sodium sulfate (anhydrous) and 20 g/l of sodium carbonate (anhydrous).

The goods showed a clear bluish green shade having a infrared reflection of the dyeing of at most 32 percent within a range of from 700 to 1100 nm.

We claim:

1. A process for the production of camouflage dyeings and prints on synthetic or regenerated fibers or foils or on blends containing synthetic or regenerated fibers to obtain dyed materials having camouflage properties in the visible range and infrared reflection values of from 20 to 50 percent within the infrared range between 700 and 1100 nm, which comprises the steps of:
   (a) providing fibers or foils containing small amounts of carbon black as a mass coloration; and
   (b) cross-dyeing or cover-printing the mass colored fibers or foils of step (a) with a dyestuff suited for the fibers or foils in shades that provide camouflage colors in the visible range of the spectrum.

2. A process as claimed in claim 1, wherein the fibers or foils contain, as a mass coloration, carbon black in amounts of from 0.005 to 0.5 percent by weight.

3. A process as claimed in claim 1 wherein the fibers or foils contain, as a mass coloration, carbon black in amounts of from 0.01 to 0.1 percent by weight.

4. A process as claimed in claim 1 wherein the carbon black is introduced by spun-dyeing.

5. A process as claimed in claim 1 wherein the material is a polyester, polyamide or regenerated cellulose.

6. A process as claimed in claim 1 wherein the material is polyethylene terephthalate.

7. A process as claimed in claim 1 wherein the material is a synthetic.

* * * * *